US005581842A

United States Patent [19]

Seith

[11] Patent Number: 5,581,842

[45] Date of Patent: Dec. 10, 1996

[54] QUICK CHANGE VACUUM BAG ADAPTER

[75] Inventor: Warren A. Seith, Wispering Pines, N.C.

[73] Assignee: Ingersoll-Rand Company, Woodcliff Lake, N.J.

[21] Appl. No.: 587,348

[22] Filed: Jan. 16, 1996

[51] Int. Cl.[6] ..... A47L 9/14

[52] U.S. Cl. ..... 15/347; 15/351; 55/375

[58] Field of Search ..... 15/347, 351; 55/369, 55/374, 375

[56] References Cited

U.S. PATENT DOCUMENTS

| | | | |
|---|---|---|---|
| 1,394,940 | 10/1921 | Rosenfield . | |
| 1,553,076 | 9/1925 | Halsted | 55/374 X |
| 1,832,846 | 11/1931 | Gudka . | |
| 1,855,672 | 4/1932 | Gudka . | |
| 2,047,735 | 7/1936 | Hunsdorf | 55/375 X |
| 2,085,702 | 6/1937 | Kitto . | |
| 2,143,970 | 1/1939 | Blood | 51/170 |
| 2,555,742 | 6/1951 | Grue | 230/274 |
| 2,580,630 | 1/1952 | White | 55/374 |
| 2,610,702 | 9/1952 | Thornwald | 55/375 X |
| 3,668,736 | 6/1972 | Loscalzo | 15/347 X |
| 4,157,252 | 6/1979 | Baird | 55/374 |
| 4,364,757 | 12/1982 | Leonatti | 55/357 |
| 4,697,389 | 10/1987 | Romine | 51/180 |
| 4,720,887 | 1/1988 | Bosyj et al. | 15/351 |
| 4,749,386 | 6/1988 | Strohmeyer et al. | 55/131 |
| 4,791,699 | 12/1988 | Sovis et al. | 15/347 X |
| 4,800,614 | 1/1989 | Kopco et al. | 15/347 X |
| 5,057,131 | 10/1991 | Lackner et al. | 15/347 X |
| 5,220,753 | 6/1993 | Whitman | 51/273 |
| 5,384,984 | 1/1995 | Smith | 451/357 |

*Primary Examiner*—Chris K. Moore
*Attorney, Agent, or Firm*—Walter C. Vliet

[57] ABSTRACT

A cylindrical adapter is fitted to the end of a standard vacuum hose having a sliding collar disposed thereon to selectively engage the adapter with a disposable vacuum bag in crimping engagement between the adapter on the collar so as to secure the disposable bag on the adapter and thereafter permit a durable vacuum slidingly engaged on the vacuum hose to be deployed about the disposable bag.

6 Claims, 2 Drawing Sheets

QUICK CHANGE VACUUM BAG ADAPTER

BACKGROUND OF THE INVENTION

This invention relates generally to the attachment of vacuum bags to a dust collecting vacuum device and more particularly to a connection between a standard ribbed vacuum hose and a standard type "C" disposable vacuum bag for use with a portable air operated sanding device or the like.

Currently, certain pneumatic operated braiding tools utilize a venturi to create a self generated vacuum in use. The vacuum captures airborne dust or particles and conveys them along with tool exhaust and/or supplemental air to a cloth bag which is attached to the receiving end of a standard vacuum hose. The cloth bag filters the dust or particles from the air and require periodic emptying of the bag contents. To avoid the need for shaking out the collected dust or particles, it would be more convenient to use disposable paper filter bags which would not need to be emptied and offer improved performance by virtue of their good flow characteristics when new. The problem is that currently there is no means for creating a connection between a standard type "C" disposable paper vacuum bag and a standard ribbed vacuum hose strong enough to prevent the bag from blowing off and which does not allow dust to escape while being easily removed when the bag needs to be replaced.

The foregoing illustrates limitations known to exist in present devices and methods. Thus it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a quick change vacuum bag adapter comprising a cylindrical body having an internal bore adapted at one end to receive a vacuum hose secured within the bore; a cylindrical collar having an internal bore slidingly disposable from a position surrounding the hose to a position at least partly engaging the internal bore of the collar with an external portion of the cylindrical body; a disposable filter bag having an opening at one end of sufficient diameter to receive the cylindrical body inserted therein; a durable filter bag having an opening at one end of sufficient diameter to slidingly receive the vacuum hose but not the collar; and the durable filter bag being further provided with a selectively closable opening at another end of sufficient size to receive the disposable filter bag upon assembly of the disposable filter bag over the cylindrical body in crimping interspace between the cylindrical body and the collar and sliding the durable filter bag over the disposable filter bag.

The foregoing and other aspects of the invention will become apparent from the following detailed description of the invention when considered in conjunction with the accompanying drawing figures.

BRIEF DESCRIPTION OF THE DRAWING FIGURES

DETAILED DESCRIPTION

Figures 1, 2:
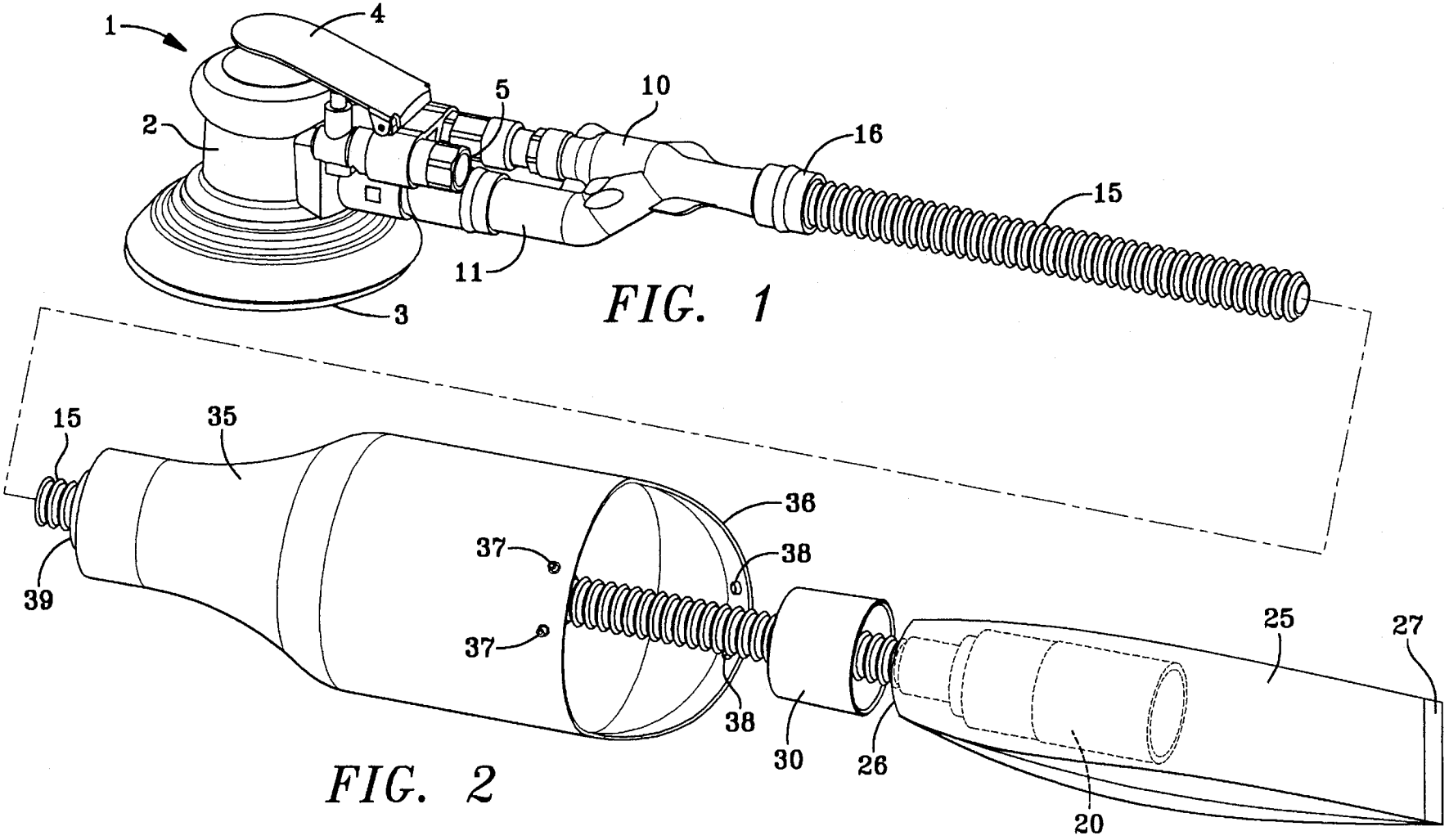
FIG. 1 is a schematic view illustrating an embodiment of the application of the present invention to a hose attached to a palm sander.
FIG. 2 is a schematic illustration showing the adapter according to the present invention in continuation of FIG. 1 showing the component parts in preassembled relationship.

Referring to FIG. 1, a palm sander is generally designated by the reference numeral 1. The sander comprises a motor portion 2, a sanding disk 3, and an operating handle 4, which when depressed, causes the motor to run on compressed pneumatic fluid and work to be accomplished by the sanding disk 3. Compressed pneumatic fluid is supplied at inlet 5 by a conventional pneumatic hose connection, not shown.

Attached to the sander 1 is a venturi vacuum creating device 10 which utilizes exhaust air from the pneumatic motor 2 and supplemental bypass air, if necessary, to create a vacuum which evacuates dust from the work area by means of vacuum connection 11. The exhaust air and collected particles are conveyed into the vacuum hose 15 through a standard hose type connection 16.

FIG. 2 shows the continuation of the standard ribbed vacuum hose 15 which terminates at its end in a quick change vacuum bag adapter 20 according to the present invention. Shown disposed over the adapter 20 is a standard type "C" disposable vacuum bag 25. The mouth 26 of the vacuum bag 25 is just large enough in diameter to slip over the adapter 20. The opposite end 27 of the disposable vacuum bag 25 is sealed to form a receptacle for collected dust particles within the expanded fold design of the bag.

As shown in its partially assembled form in FIG. 2, a collar 30 is slidingly disposed on the vacuum hose 15 along with a protective cloth vacuum bag 35. The cloth vacuum bag 35 is large enough in size to accommodate the disposable paper vacuum bag and is provided with a foldable seal flap 36, which after assembly over the disposable bag, may be snap shut by means of a plurality of friction snaps 37 having a mating friction snap part 38 on the flap. The opposite end of the cloth bag is provided with an opening of sufficient diameter to allow the ribbed nose 15 to pass, but is of insufficient diameter to allow the cloth bag to pass over collar 30.

Figure 3:
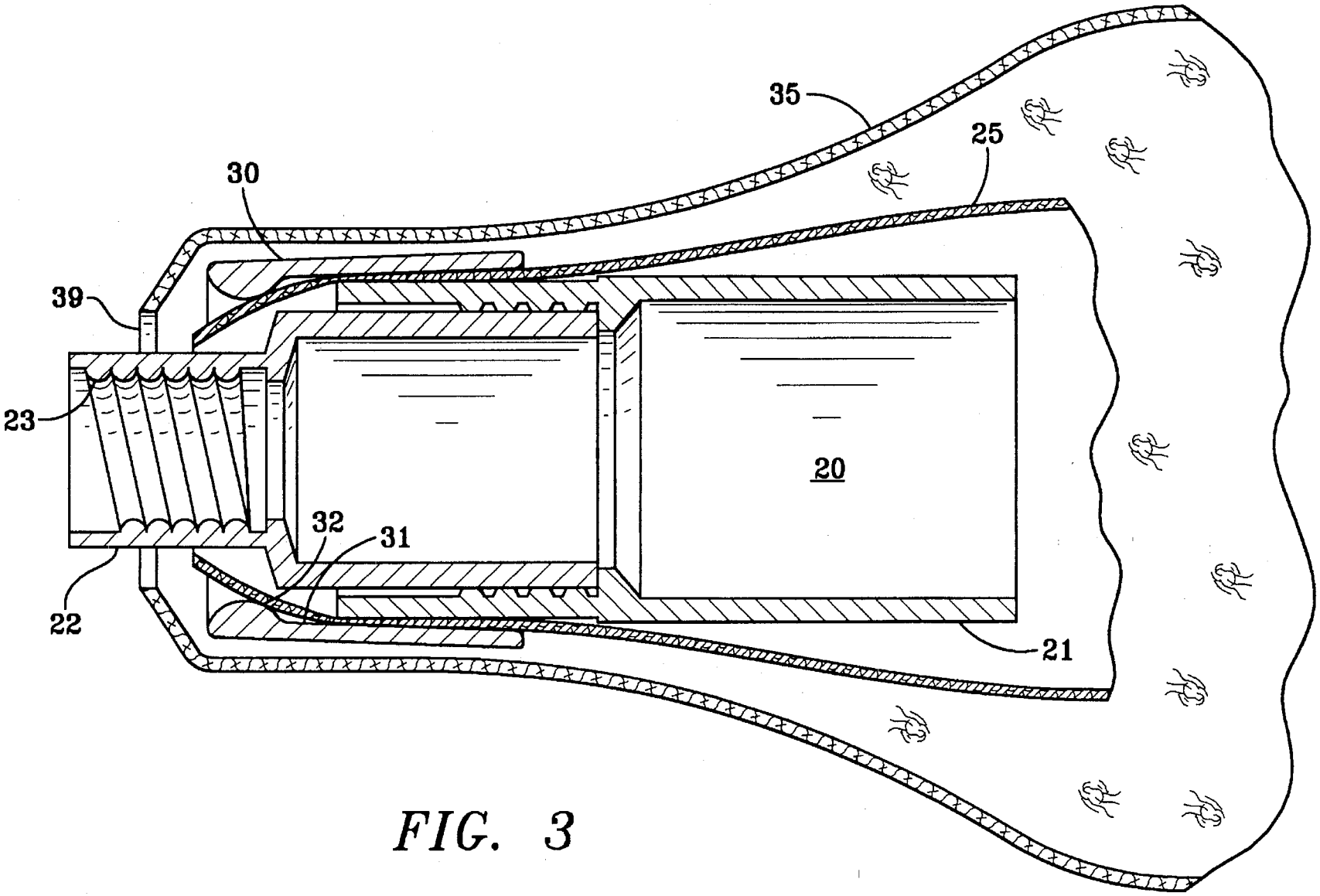
FIG. 3 is a cross section of the coupling according to the present invention showing the assembled quick change vacuum bag adapter.

Collar 30 is provided with a tapered interferenced fit internal diameter 31 and a stop 32. The tapered internal diameter 31 of collar 30 is of a sufficient diameter to just pass over the external diameter 21 of adapter 20. The adapter 20 is shown in FIG. 3 secured to the external diameter of a hose adapter 22 which has a threaded engagement portion 23 for receiving and securing the end of the standard ribbed vacuum hose 15. The present invention permits a quick and efficient connection between a standard ribbed vacuum hose and a disposable vacuum bag.

To connect a new disposable vacuum bag 25 the cloth bag 35 is first inserted over the vacuum hose 15 with its smaller diameter end 39 towards the sander 1. Collar 30 is next inserted over the vacuum hose 15 with its stop end 32 towards the sander 1. The bag adapter 20 and its connector 22 is next secured to the vacuum hose 15 by means of the threaded portion 23. The open end 26 of the disposable vacuum bag 25 is next inserted over the adapter 20 until the adapter is fully within the disposable bag. At this point the collar 30 is advanced over the disposable bag and adapter to the position shown in FIG. 3, wherein the interference fit between collar 30 and the disposable bag 25 and the bag adapter 20 pinches the bag 25 and thereby effectively seals it and also creates friction between the adapter 20 and the disposable bag 25. Stop 30 prevents the collar from advancing too far. The cloth bag or sock 35 is then advanced over the paper bag 25 and the friction snaps 37, 38 at the open end of the cloth bag are secured.

The cloth sock bag 35 protects the paper bag from abrasive damage in a work environment and also prevents the bag from tearing open as a result of pressure which builds up inside. To remove the paper bag, the above procedure is followed in reverse order and the contents of the disposable paper bag may be disposed of in a clean and efficient manner.

Having described my invention in terms of a preferred embodiment, I do not wish to be limited in the scope of my invention except as claimed.

What is claimed is:

1. A quick change vacuum bag adapter comprising:

a cylindrical body having an internal bore adapted at one end to receive a vacuum hose secured within said bore;

a cylindrical collar having an internal bore slidingly disposable from a position surrounding said hose to a position at least partly engaging said internal bore of said collar with an external portion of said cylindrical body;

a disposable filter bag having an opening at one end of sufficient diameter to receive said cylindrical body inserted therein;

a durable filter bag having an opening at one end of sufficient diameter to slidingly receive said vacuum hose but not said collar; and said durable filter bag being further provided with a selectively closable opening at another end of sufficient size to receive said disposable filter bag upon assembly of said disposable filter bag over said cylindrical body in crimping interspace between said cylindrical body and said collar and sliding said durable filter bag over said disposable filter bag.

2. A quick change vacuum bag adapter according to claim 1, wherein said cylindrical body is provided with an internal thread in said one end.

3. A quick change vacuum bag adapter according to claim 1, wherein said vacuum hose is a standard ribbed vacuum hose.

4. A quick change vacuum bag adapter according to claim 1, wherein said disposable vacuum bag is a standard type "C" super filter bag.

5. A quick change vacuum bag adapter according to claim 1, wherein said durable vacuum bag is a cloth bag.

6. A quick change vacuum bag adapter according to claim 5, wherein said closable opening is secured by quick fasteners.

* * * * *